United States Patent [19]

Loepfe

[11] 4,349,784

[45] Sep. 14, 1982

[54] DEVICE FOR MONITORING YARN MOTION ON A TEXTILE MACHINE

[75] Inventor: Erich Loepfe, Pfaffhausen, Switzerland

[73] Assignee: Gebrueder Loepfe AG, Zurich, Switzerland

[21] Appl. No.: 161,738

[22] Filed: Jun. 23, 1980

Related U.S. Application Data

[62] Division of Ser. No. 943,526, Sep. 18, 1978, Pat. No. 4,256,247.

[30] Foreign Application Priority Data

Oct. 5, 1977 [CH] Switzerland ..... 12160/77

[51] Int. Cl.[3] ..... H03K 9/06

[52] U.S. Cl. ..... 328/138; 328/140; 57/352

[58] Field of Search ..... 328/26, 140, 138; 57/352

[56] References Cited

U.S. PATENT DOCUMENTS

| | | | |
|---|---|---|---|
| 3,231,823 | 1/1966 | Garfield et al. | 328/140 X |
| 3,545,258 | 12/1970 | Judd | 328/140 X |
| 3,581,220 | 5/1971 | Bell et al. | 328/140 X |
| 3,942,095 | 3/1976 | Togneri et al. | 328/26 X |

*Primary Examiner*—John S. Heyman

*Attorney, Agent, or Firm*—Werner W. Kleeman

[57] ABSTRACT

An electronic circuitry for evaluating electrical sensing signals furnished by a sensing device responsive to ballooning motion of a yarn in a textile machine and delivering a series of high frequency pulses having a repetition rate corresponding to the low frequency of the ballooning motion, comprises a series arrangement of an A.C.-amplifier, a rectifier, a low-pass filter having an upper cut-off frequency smaller than said high frequency but greater than the low frequency of the ballooning motion, and a frequency discriminator made up of a high-pass filter and integrator, and a final stage to either indicate improper yarn ballooning or disable the machine operation.

1 Claim, 14 Drawing Figures

DEVICE FOR MONITORING YARN MOTION ON A TEXTILE MACHINE

CROSS-REFERENCE TO RELATED CASE

This application is a divisional application of my commonly assigned, United States application Ser. No. 943,526, filed Sept. 18, 1978, entitled "DEVICE FOR MONITORING YARN MOTION ON A TEXTILE MACHINE", now U.S. Pat. No. 4,256,247, granted Mar. 17, 1981.

BACKGROUND OF THE INVENTION

The present invention refers to a novel device for monitoring motion, particularly ballooning motion, of a thread or yarn travelling on a textile machine, the device comprising sensing means producing an electrical sensing signal when contacted by the travelling yarn. The invention also relates to electronic circuitry for processing said electrical sensing signal.

Swiss Pat. No. 457,228 discloses an electronic yarn monitor mounted at a winding machine wherein the travelling yarn performs a traversing motion, and a sensor is arranged in the traversing area. The embodiments of this patent comprise optical and capacitive sensors. Further there is stated that several sensors may be located in the traversing area. The travelling yarn due to the traversing motion produces an A.C. voltage which disappears upon yarn break or standstill and thus is indicative of yarn motion.

Swiss Pat. No. 583,656 discloses dynamoelectrical sensing devices adapted for monitoring the motion of oblong or extended objects, such as threads or yarns. Most of these known sensing devices are designed as hollow cylindrical structures comprising at least one insulating guide body, ground and signal electrodes, and a yarn passageway. The ground and signal electrodes extend over the entire circumference of the insulating guide body. The formation of the sensing signal is based on the effect that high frequency electrical signals having noise character are produced by the friction occurring between travelling thread and insulating guide body.

SUMMARY OF THE INVENTION

It is a primary object of the invention to provide a sensing device for monitoring ballooning motion of travelling threads or yarns.

It is another object of the invention to provide such sensing devices adapted to produce A.C. voltage sensing signals.

It is a more specific object of the invention to provide sensing devices for producing modulated high frequency sensing signals, and electronic circuitry transforming such sensing signals into demondulated or D.C. output signals.

Now in order to implement the aforementioned objectives and others which will become more readily apparent as the description proceeds, the sensing device of the invention comprises a yarn guide structure forming a yarn channel surrounding the travelling yarn and provided with yarn motion responsive and non-responsive elements arranged in alternate sequence at said yarn guide structure in circumferential direction of the yarn channel.

In the following context the invention is illustrated referring to schematic drawings which represent various sensing devices and an electronic circuitry for evaluating the sensing signals. The connections attached to the electrodes are not shown for the sake of clearness.

BRIEF DESCRIPTION OF THE DRAWINGS

The invention will be better understood and objects other than those set forth above will be apparent upon consideration of the following detailed description thereof which makes reference to the annexed drawings wherein.

DETAILED DESCRIPTION OF THE INVENTION

In the following context referring to FIGS. 1*a*, 1*b* through 6*a*, 6*b* the sensing elements furnishing electrical sensing signals on passage of a ballooning thread are termed collector electrodes.

Figure 1A:
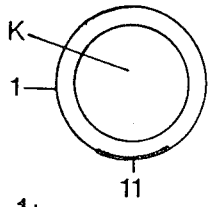
FIGS. 1*a* and 1*b* show a hollow cylindrical sensing device in schematic plan view and side elevation.
Figure 1B:
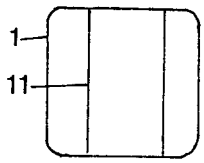

With reference to FIGS. 1*a* and 1*b* the sensing device comprises a hollow cylindrical yarn guide body 1 surrounding a yarn channel K, and a collector electrode 11 attached to the exterior surface of yarn guide body 1. Collector electrode 11 extends in axial direction of yarn channel K over the entire length of yarn guide body 1, however in peripheral direction only over part of the latter forming a sector of about 60°. The remaining portion which is not covered by collector electrode 11 forms a neutral zone which does not substantially contribute to the sensing signal.

Figure 2A:
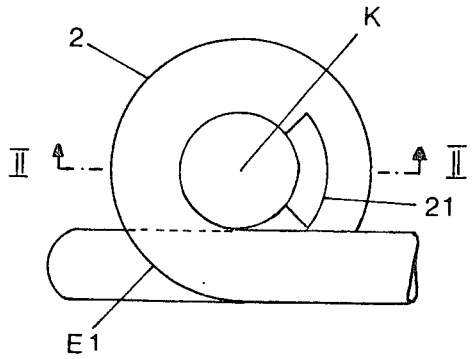
FIGS. 2*a* and 2*b* illustrate an embodiment of a pigtail sensing device in plan view and axial cross-section.
Figure 2B:
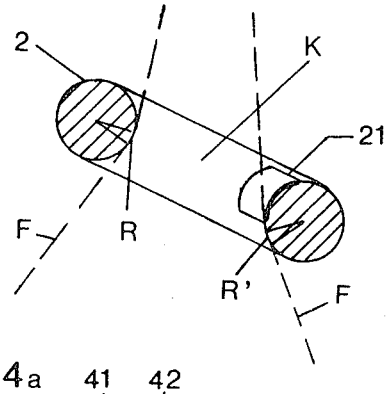

FIGS. 2*a* and 2*b* show a pigtail yarn guide or yarn guide body 2 of conventional shape made of ceramics and provided with a collector electrode 21 at the interior surface or wall surrounding yarn channel K. Collector electrode 21 extends over about one quarter of the periphery of yarn channel K. FIG. 2*b* shows an axial cross-section along the line II—II in FIG. 2*a* wherein the dashed lines F show the yarn path or limitation of the balloon. R and R′ refer to the sections of the friction zones intersected by the plane of the drawing, along which friction zones the ballooning yarn is contacting yarn guide body 2. As may be seen from FIG. 2*b* collector electrode 21 is arranged at the interior surface of yarn guide body 2 immediately above friction zone R′, thus avoiding wear of the edge portions of collector electrode 21.

Figure 3A:
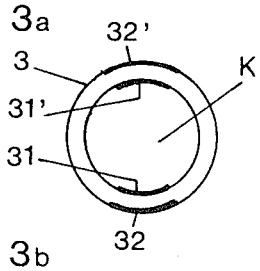
FIGS. 3*a* and 3*b* show a hollow cylindrical sensing device comprising two electrodes in plan view and side elevation.
Figure 3B:
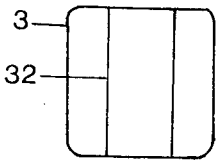

FIGS. 3*a* and 3*b* show a sensing device comprising a hollow cylindrical yarn guide body 3 bearing two diametrically arranged collector electrodes 31, 31′ on the interior surface thereof, and two diametrically arranged ground electrodes 32, 32' at the exterior surface. All the electrodes extend over a sector of about 45° in peripheral direction and over the entire length of yarn channel K of yarn guide body 3 in axial direction. Each of the ground electrodes 32, 32' and the corresponding collector electrode 31 and 31' cover an equal sector in such a manner that the collector electrodes are shielded by the ground electrodes 32, 32'.

Figure 4A:
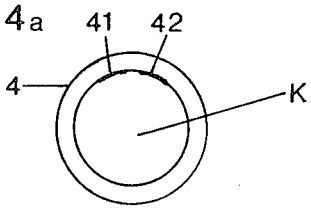
FIGS. 4*a* and 4*b* show a similar sensing device of different electrode structure in plan view and axial cross-section.
Figure 4B:
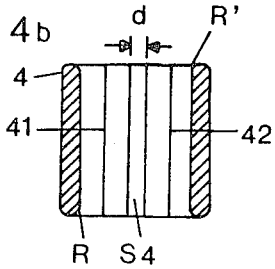

Referring to FIGS. 4*a* and 4*b* a collector electrode 41 and a ground electrode 42 are arranged at a small distance d from each other on the interior surface of a hollow cylindrical yarn guide body 4, thus forming a small gap S4 between them. Those electrodes 41, 42 are small in the direction of the periphery of yarn channel K and extend over the entire length of yarn guide body 4 in axial direction. Ring-shaped friction zones R and R' are located at the lower and upper ends, respectively, of yarn channel K and yarn guide body 4.

Figure 5A:
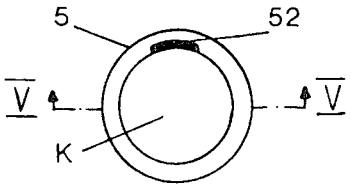
FIGS. 5*a* and 5*b* represent a ring-shaped sensing device provided with two electrodes in plan view and axial cross-section along the line V—V in FIG. 5*a*, respectively.
Figure 5B:
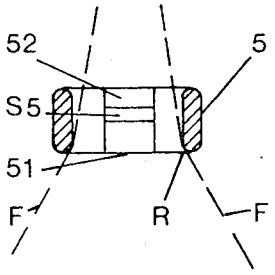

In FIGS. 5*a* and 5*b* there is represented a ring-shaped sensing device comprising a yarn guide body 5 at whose interor surface there are arranged a collector electrode 51 and a ground electrode 52 succeeding one another in axial direction. Between those electrodes there is a small gap S5 extending in peripheral direction of yarn channel K. The dashed lines F indicate the yarn path or limitation of the balloon.

The sensing devices shown in FIGS. 1, 3 and 4 are symmetrical relative to a length middle plane thereof and comprise a friction zone R or R' at each end of yarn channel K as shown in FIG. 4*b*, so that these devices may be mounted irrespective of the direction of their longitudinal axes.

The yarn guide bodies 1–5 are preferably made from a hard electrically insulating material, such as ceramic oxide. The electrodes may advantageously be covered by a hard layer for protecting the same against wear by the running yarn. By way of example the electrodes may be made by plasma plating.

The sensing devices shown in FIGS. 1–5 may be modified in various manners. When the collector electrodes are arranged on the interior surface of the yarn guide body surrounding yarn channel K, the yarn guide body may comprise a metallic core provided with a hard insulating cover. Such a metallic core may be used as a ground electrode simultaneously shielding the collector electrode.

Figure 6A:
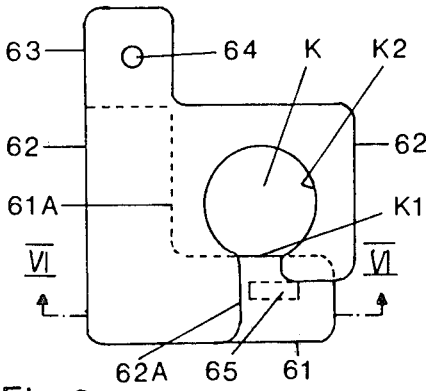
FIGS. 6*a* and 6*b* show a sensing device provided with an insert gap in plan view and cross-sectional view along the line VI—VI of FIG. 6*a*, respectively.
Figure 6B:
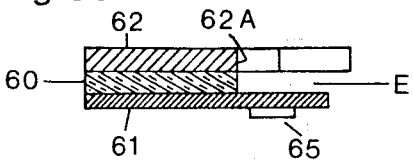

FIG. 6*a* shows an essentially rectangular sensing device comprising, as may be seen from FIG. 6*b*, three plate-shaped structural elements 60, 61 and 62 in sandwich arrangement. The lower plate 61 is made of metal and serves as a collector electrode. The latter has the shape of an L whose interior edge is represented by the dashed line 61*a*. The upper essentially rectangular plate 62 which also consists of metal serves as a basic structural element and ground electrode, and is provided with a circular recess or bore having at one side thereof an opening at K1. Yarn channel K is mainly confined by the circular interior edge of plate 62 and by a section K1 of the interior edge of lower plate 61. The plates 61 and 62 are interconnected by an intermediate plate 60 made of insulating material. Intermediate plate 60 is also L-shaped and has a short leg whose right edge is in register with the edge 62*a* of the upper plate 62. Thus a free space serving as an insert gap E is provided at the right side of edge 62*a* and between the plates 61 and 62 allowing insertion of a thread or yarn in radial direction into yarn channel K. The upper plate 62 is provided with an extension 63 having a bore 64 for mounting the sensing device on a machine. As may be seen from FIG. 6*a*, the yarn channel K is confined by the plate-shaped electrodes 61, 62 in alternate sequence.

This embodiment of the sensing device may advantageously be used in the place of the one shown in FIGS. 2*a* and 2*b* for sensing a ballooning yarn and producing a signal indicative of a ballooning motion only during time intervals in which the yarn is contacting collector electrode 61 at the edge K1 thereof beneath insert gap E.

That embodiment may be modified variously and accommodated to any use in question. By way of example the upper plate 62 may be made of an insulating material rather than metal, or it may be covered by a hard insulating material. Collector electrode 61 may also be provided with a hard insulating layer. Preferably ceramic oxide of great surface hardness is used as an insulating material for this purpose.

In an alternative embodiment there may be attached to the lower plate 61 serving as a sensing element a piezoelectrical element 65 which may be vibrated by the mechanical vibrations of the exposed portion of plate 61 when the latter is contacted by the travelling yarn, whereby an electrical sensing signal shaped as an A.C. pulse series is generated.

Figure 7:
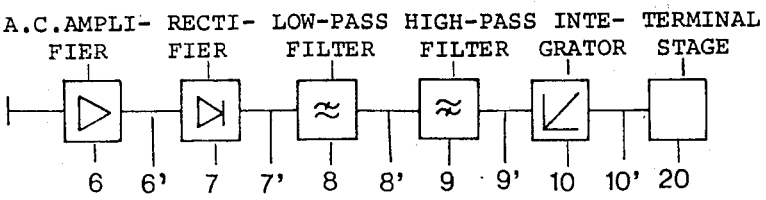
FIG. 7 represents a simple embodiment of an electronic evaluation circuitry in block schematic.

The electronic evaluation circuitry shown in FIG. 7 not only serves for monitoring yarn travel but also for surveying the frequency of the ballooning motion of a yarn, that is the frequency of the rotation of the yarn section forming the balloon, e.g. on a ring-spinning machine or balloon forming twisting machine. This evaluation circuitry is of particular importance with double twisting machines of the type in which a thread is drawn from a delivery bobbin over a slowly rotating flyer to the top of a thread insert tube, and from the top thereof downwards to the lower end of the tube. From this lower end, the yarn is conducted over a quickly rotating disk outwards, then forming a quickly rotating balloon section extending upwards into a yarn guide, and therethrough passing to a take-up spool.

In the event of a yarn break in the balloon forming yarn section it may occur that the upper broken yarn end drags along the above-mentioned thread end conducted by the slowly rotating flyer. In this event yarn is further drawn off the delivery bobbin through the yarn guide, however at a "wrong", slow ballooning frequency in the range of about 1–2 Hz. This wrong operation cannot be detected by a conventional yarn travel monitor or balloon monitor, however will be discovered by the frequency evaluation circuitry as described in the following context.

The evaluation circuitry comprises a series connection of six stages connected to a collector electrode 11, comprising an A.C. amplifier 6, rectifier 7, low-pass filter 8, high-pass filter 9, integrator 10 and terminal stage 20. The evaluation circuitry is designed such that the terminal stage 20 produces no output signal as long as the ballooning frequency of the yarn remains within a predetermined range, however terminal stage 20 is actuated and furnishes an alarm signal and/or a signal for stopping the machine as soon as the frequency decreases below a predetermined lower limit, or the yarn breaks. Thus the evaluation circuitry also functions as a yarn break monitor.

It is to be understood that high-pass filter 9, integrator 10 and terminal stage 20 together function as a frequency discriminating means. These stages 6–10 may be designed in conventional manner and thus need not be described in detail. Terminal stage 20 may be a power stage actuating a relay or an indication device.

Figure 8:
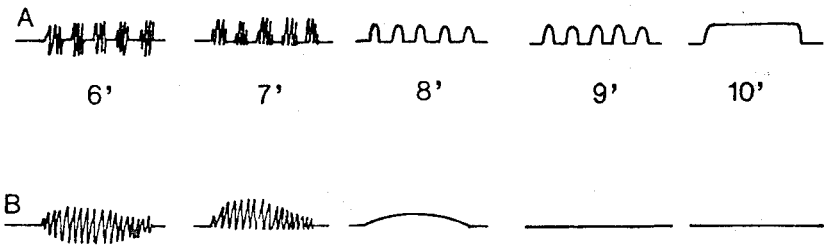
FIG. 8 comprises signal diagrams illustrating the operation of the evaluation circuitry of FIG. 7.

The mode of operation of the evaluation circuitry shown in FIG. 7 is illustrated, by way of example, by FIG. 8. Assuming the ballooning frequency is in the range of 100–200 Hz, e.g. 150 Hz, with the undisturbed run of the machine. The signals produced in the single stages 6–10 of the evaluation circuitry are shown in the diagrams at A of FIG. 8 and labelled 6'–10'. The A.C. amplifier 6 produced high frequency pulses 6' of the repetition rate 150 Hz as sensing signals. The pulses 7' produced by the following rectifier 7 are transformed by low-pass filter 8 into a pulsing D.C. voltage 8'. Low-pass filter 8 may have an upper cut-off frequency of e.g. 500 Hz. The demodulated signal 8' passes substantially unchanged high-pass filter 9 whose lower cut-off frequency may be 20 Hz. The output signal 9' of high-pass filter 9 is transformed by integrator or smoothing stage 10 into a D.C. voltage 10' which is supplied to terminal stage 20.

Now when the frequency of the ballooning motion is substantially below the lower cut-off frequency 20 Hz of high-pass filter 8 there results the pulse sequence shown in diagrams B. The demodulated sensing signal, that is the output signal 8' of low-pass filter 9, exists as a pulsing D.C. voltage of very low frequency, however this signal 8' is suppressed by high-pass filter 9 and the output signal of the integrator 10 becomes zero.

By such an evaluation of the high frequency sensing signal 6' produced by the sensing device 6, a normal or correct sensing signal 6' as shown at A in FIG. 8 is demodulated into a signal 8' pulsing with a low frequency of 150 Hz, that is a normal ballooning frequency. However, by the following filtration in high-pass filter 9 the above-mentioned "wrong" ballooning frequency of 1–2 Hz as shown at B in FIG. 8 is suppressed and thus detected by the evaluation circuitry as a failure.

In place of a further filtration by high-pass filter 9 which together with low-pass filter 8 forms a band-pass, the demodulated signal 8' may be supplied to a pulse counter, frequency counter or the like frequency discriminating means.

While there are shown and described present preferred embodiments of the invention, it is to be distinctly understood that the invention is not limited thereto but may be otherwise variously embodied and practised within the scope of the following claims. Accordingly,

What I claim is:

1. An electronic circuitry for evaluating electrical sensing signals furnished by a sensing device responsive to ballooning motion of a yarn in a textile machine and delivering a series of high frequency pulses having a repetition rate corresponding to the low frequency of the ballooning motion, the electric circuitry comprising a series arrangement of A.C.-amplifying means, rectifying means, low-pass filtering means having an upper cut-off frequency smaller than said high frequency but greater than the low frequency of the ballooning motion, high-pass filtering means having a cut-off frequency lower than the frequency of the ballooning motion, and means for detecting whether or not the output of the low-pass filtering means is a pulse series indicative of the frequency of the ballooning motion.

* * * * *